United States Patent [19]

Petrillo

[11] Patent Number: 5,056,949

[45] Date of Patent: Oct. 15, 1991

[54] CORRECTION FLUID DISPENSER WITH BALL VALVE

[75] Inventor: Richard J. Petrillo, Norwell, Mass.

[73] Assignee: The Gillette Company, Boston, Mass.

[21] Appl. No.: 593,239

[22] Filed: Oct. 5, 1990

[51] Int. Cl.[5] ..... B43K 7/00; B43K 7/10

[52] U.S. Cl. ..... 401/214; 401/260; 401/264

[58] Field of Search ..... 401/214, 260, 264

[56] References Cited

U.S. PATENT DOCUMENTS

| | | | |
|---|---|---|---|
| 1,485,181 | 2/1924 | Grund | 401/214 |
| 2,192,479 | 3/1940 | Nissen, Jr. | 401/214 X |
| 2,663,891 | 12/1953 | Hanryon | 401/214 X |
| 2,719,314 | 10/1955 | Taube | 401/214 |
| 3,379,490 | 4/1968 | Schwartzman | 401/214 |
| 4,573,820 | 3/1986 | Kirchhoff | 401/214 |

FOREIGN PATENT DOCUMENTS

| | | | |
|---|---|---|---|
| 511429 | 5/1952 | Belgium | 401/214 |
| 697595 | 10/1940 | Fed. Rep. of Germany | 401/214 |
| 679441 | 4/1930 | France | 401/214 |
| 964045 | 7/1950 | France | 401/214 |
| 58420 | 11/1953 | France | 401/214 |

*Primary Examiner*—Steven A. Bratlie

*Attorney, Agent, or Firm*—John P. Morley; Aubrey C. Brine

[57] ABSTRACT

A correction fluid dispenser comprising a body member adapted to retain a correction fluid and a barrel disposed at one end thereof for delivery of the fluid to a surface. The barrel terminates in an orifice formed by a circular rim with a spherical ball of greater diameter disposed at the orifice. The ball is supported by a socket member, the ball and socket means being spring biased toward the orifice. A stop means is provided to prevent the ball from extending entirely within the rim of the orifice.

8 Claims, 1 Drawing Sheet

CORRECTION FLUID DISPENSER WITH BALL VALVE

BACKGROUND OF THE INVENTION

The present invention relates to fluid dispensers, and more particularly to a correction fluid dispenser of the pencil or pen type for correcting typewriter or other printed errors.

The correction of errors occurring in typewritten material or other printed media is frequently accomplished by an operator applying a white liquid substance onto the typed page by means of a brush which is dipped into a bottle containing the substance. After the substance over the erased area has dried, the correct character is entered on the dried layer of white substance, or correction fluid. While this method may prove adequate in many instances, the employment of the separate elements (brush and bottle of liquid) is not considered to be the optimum in efficient application of the correction fluid in that the brush must be removed from the fluid and replaced after each erasure, and the bottle sealed in order to retain the correction fluid in a liquid state.

Correction fluid dispensers of the pencil or pen type are also offered on the market, and have been found to provide a more compact device which is simple to use and to store than the brush and bottle type discussed above. Generally, these devices have internally a spring biased plunger which closes the discharge orifice of the device to prevent drying of the correction fluid reservoir. Pressure applied to the point of the device operates to push the plunger back into the device and clear off the discharge orifice to permit flow of correction fluid through the orifice. A problem that has persisted with these devices lies in the fact that a forcible spring bias is required to maintain the plunger in an orifice blocking position, tight and secure enough to prevent drying of the fluid. On the other hand, for proper functioning of the device, it is important that the orifice be cleared by very light pressure upon the point. The latter is a desirable feature because it often happens that the only backing or support for the paper during a correction operation is the hand of the operator.

Many of these constructions therefore that provide a secure fluid shutoff are difficult to operate while those that are easy to operate suffer from drying of the fluid reservoir.

It is therefore an object of the present invention to provide a correction fluid dispenser providing both ease of operation and a positive seal against drying of the correction fluid.

A further object of the invention is to provide a correction fluid dispenser which will correct the single letter without blobbing and deliver fluid with a smooth continuous rolling motion without the need to dab the pen to promote fluid flow.

A further object of the invention is to provide a correction fluid dispenser of the pencil or pen type which is simple to manufacture and has a minimum number of components.

SUMMARY OF THE INVENTION

The above objects and other objectives which will become apparent as the description proceeds are achieved by providing a correction fluid dispenser having a body member adapted to maintain the correction fluid combined with a barrel disposed at one end of the body member for delivery of the correction fluid from the body member to the surface upon which a correction is to be made. The barrel is provided with an orifice formed by a circular rim at the end thereof, opening into a tubular passage which extends to an opening into the body member. A spherical ball having a greater diameter than the orifice circular rim is disposed within the tubular passage adjacent the orifice and is supported by a socket member having a surface contacting the spherical ball. The socket member is disposed within the tubular passage for movement axially toward and away from the circular rim and a spring means is disposed within the tubular passage for biasing the socket member toward the orifice circular rim.

The socket member is generally prevented from moving a predetermined distance from the circular rim by a stop means provided within the barrel, thus preventing the ball from moving inwardly entirely beyond the circular rim and the subsequent contact of the rim with the surface on which a correction is to be made.

In a more detailed sense, the dispenser may be provided with a tubular retainer disposed within the barrel tubular passage having the spring disposed therein. The retainer is provided with a stop surface in facing relation with the socket member such that the stop surface is spaced from the circular orifice to prevent movement of the socket member, and the ball member, away from the circular rim the predetermined distance.

The socket member generally comprises wall structure which contacts the tubular body for slidable engagement within the tubular passage during axial movement and a plurality of ribs are provided extending axially with respect to the tubular passage to provide a substantial opening for flow of correction fluid between the ribs, during operation of the dispenser.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
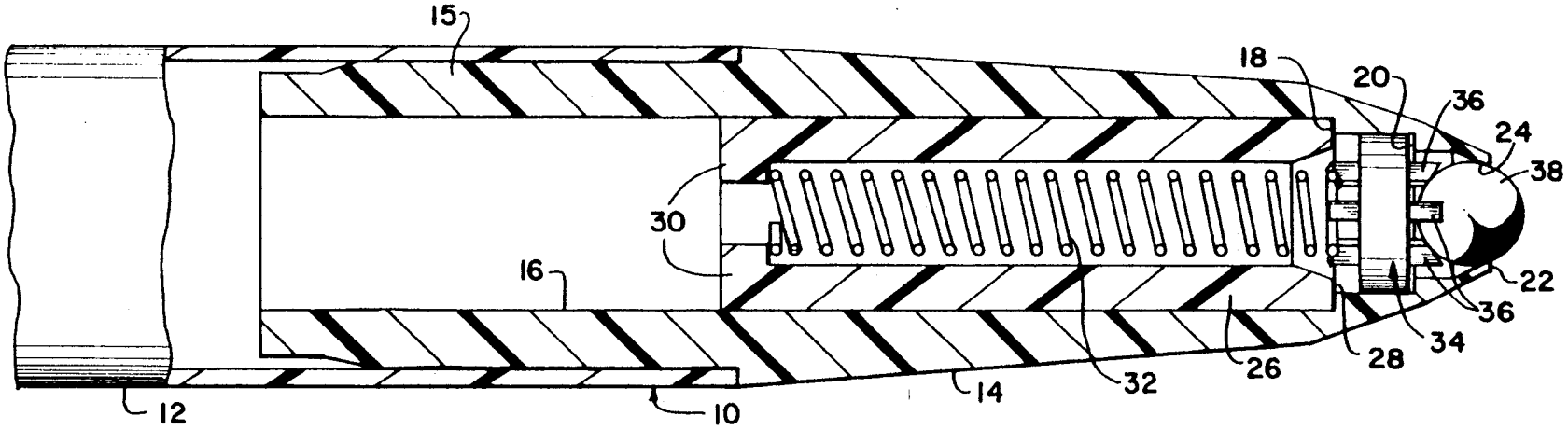
FIG. 1 is a sectional elevational view showing a portion of a correction fluid dispenser constructed in accordance with the teachings of the present invention.

Referring now to the drawing and in particular to FIG. 1, there is shown a correction fluid dispenser 10 comprising an elongated body member 12 and a barrel 14. Only a portion of the body member 12 is depicted in FIG. 1. It should be understood, however, that the body member extends axially from the barrel 14 to form a pen or pencil type device for manipulation by the hand of the user, and is capable of containing a desired quantity of correction fluid composition for gravity flow from the body member.

The barrel 14 is tubular in structure and has a rearward portion 15 of external diameter to provide a press fit with the internal diameter of the body member 12, for assembly purposes. A tubular passage 16 extends through the barrel 14 and opens rearwardly into the body member 12 for flow of correction fluid from the body member into the barrel 14. The tubular passage 16 has a pair of circumferential shoulders 18 and 20 adjacent the forward end thereof, and is tapered inwardly terminating at a circular rim 22 surrounding and forming an orifice 24.

Within the tubular passage 16, a tubular spring retainer 26 is disposed in interfitting engagement with the barrel 14, the tubular retainer having an external surface providing for a force fit into the tubular passage 16 such that the forward surface 28 of the retainer has an outward portion contacting the circumferential shoulder 18 and a portion extending radially inwardly into the passage 16. The retainer 26 has an inwardly projecting portion 30 which serves to support a spring 32, the spring being of a diameter to closely fit within the inner wall of the tubular spring retainer 26.

A socket member 34 having a plurality of axial ribs 36 is supported by the spring 32 at its forward end and a spherical ball 38 is disposed between the socket member 34 and the circular rim 22 of the passage 16. The spherical ball 38 is of larger diameter than the circular rim such that only a portion of the ball extends beyond the orifice 24 with the outer surface of the ball forming a seal when contacting the circular rim 22, as shown in FIG. 1.

Figure 3:
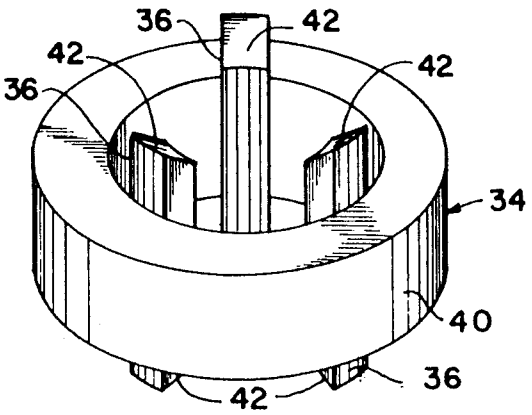
FIG. 3 is an elevational perspective view showing details of an element of the structure of FIGS. 1 and 2, taken on an enlarged scale for clarity.

Referring now to FIG. 3, it will be noted that the socket member 34 is of simple construction, comprising an annulus 40 having the three axial ribs 36 disposed in equal spacing about the inner diameter of the annulus. Each of the ribs 36 has a surface 42 formed at either end thereof, the surfaces 42 each being of the same angle with respect to the centerline of the annulus 40. The surfaces 42 serve to contact either the spherical ball 38 or the spring 32, and it should be evident that the socket member may be placed with the ribs 36 having either surface 42 facing the ball 38 or the spring 32, thus simplifying assembly of the socket member 34 into the barrel 14.

Each of the elements, the barrel 14, tubular spring retainer 26 and the socket member 34, are generally manufactured of a plastic material having good wearability to provide the necessary bearing surfaces. One such product sold under the tradename of is Delrin, which is a plastic material manufactured by E.I. DuPont de Nemours and Co.

In assembly of the dispenser 10, the spherical ball 38, which may be of any hard smooth metal material such as steel, is placed into the barrel 14 after which the socket member 34 is dropped into the barrel, the spring 32 being placed into the barrel in contact with the surfaces 42 of the ribs 36 and the tubular spring retainer 26 having its interior aligned with the spring is forced into the tubular passage 16 until the forward surface 28 of the retainer contacts the circumferential shoulder 18 of the tubular passage. The body member 12 is then filled with a correction fluid which may be of any well known in the art having a viscosity to flow through the barrel 14 under the force of gravity, and the rearward portion 15 of the barrel is pressed into the interior of the body member 12.

Figure 2:
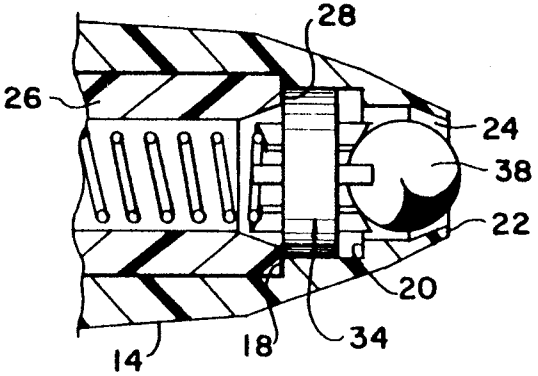
FIG. 2 is a fragmentary sectional elevation showing a portion of the structure of FIG. 1 and depicting the elements of the structure during operation of the correction fluid dispenser.

Referring now to FIGS. 1 and 2, with the structure as depicted in FIG. 1 and the forward end of the dispenser 10 pointed downwardly and placed onto the surface on which an erasure is to occur, a slight pressure is applied and the ball 38 moves inwardly from the orifice 24 to a position as shown in FIG. 2, allowing the material to flow through the tubular passage 16 and through the opening in the interior of the spring retainer 26, through the interior of the annulus 40 and over the ball 38 and thus producing a smooth flow of material from the orifice 24. It will be noted in FIG. 2 that the forward surface 28 of the retainer 26 is in facing relation with the socket member 34 and is spaced a predetermined distance from the circular orifice 24 to prevent movement of the socket member the predetermined distance away from the orifice such that a portion of the spherical ball 38 is always maintained outside of the circular orifice. Thus, the surface 28 provides a stop means for preventing both the socket member 34 and the spherical ball 38 from moving the predetermined distance from the circular rim 22 and preventing the spherical ball 38 from entering entirely into the tubular passage 16, which would allow the circular rim 22 to drag across the surface on which the erasure is to be made.

It should be noted from the above that the correction fluid dispenser 10 provides a structure that will correct a single letter without blobbing and will deliver fluid with a smooth continuous rolling motion without the need to dab the pen to promote fluid flow. Since the openings in the tubular passage 16, the spring retainer 26 and the socket member 34 are relatively large, there is a minimum of constriction in the flow path of material, which would tend to produce clogging within the barrel 14. Clogging at the orifice 24 is also minimized as the shutoff of material is accomplished by substantially a line to line contact between the spherical ball 38 and the circular rim 22. Any material that has dried at this point being released when the ball is forced rearwardly to commence the correction operation. There is, therefore, no necessity to provide a dabbing motion, or excessive pressure to the fluid dispenser 10 as the rolling motion the ball 38 aids in the clearing of dried fluid and to promote flow of correction fluid through the orifice 24. Additionally, the socket member 34 provides a smooth surface for the ball to roll against and because both the socket member 34 and the spherical ball 38 are spring loaded, the adjusting of fluid flow may be accurately accomplished by the user by applying more or less pressure during operation of the dispenser.

While it is apparent that changes and modifications may be made within the spirit and scope of the present invention, it is my intention, however, only to limited by the scope of the appended claims.

As my invention, I claim.

1. A correction fluid dispenser comprising:

a body member adapted to retain a correction fluid;

barrel means disposed at one end of said body member for delivery of correction fluid from said body member to the surface upon which a correction is to be made;

said barrel means having an orifice with a circular rim formed at the end thereof opening into a tubular passage extending to and communicating with the interior of said body member;

a spherical ball of greater diameter than said orifice circular rim disposed within said tubular passage adjacent said circular rim;

a socket member for axial movement in said tubular passage and comprising an annulus having wall structure contacting said tubular passage during axial movement of said socket member and a plurality of axially extending ribs equally spaced about a circumference of said annulus and extending beyond said annulus;

each said rib having a surface directed radially inwardly toward said annulus at either end therefor contacting said spherical ball at one rib end; and spring means disposed within said tubular passage and contacting each of said ribs at a said surface at a rib end opposite said one rib end for biasing said socket member toward said orifice circular rim.

2. A correction fluid dispenser as set forth in claim 1 further comprising stop means for preventing movement of said socket member greater than a predetermined distance from said circular rim.

3. A correction fluid dispenser as set forth in claim 1 which further includes a tubular retainer disposed within said barrel means tubular passage and having said spring means disposed therein, said retainer having a stop surface in facing relation with said socket member, said stop surface spaced a predetermined distance from said circular rim to prevent movement of said socket member away from said orifice.

4. A correction fluid dispenser as set forth in claim 3 wherein said predetermined distance is of a dimension to limit travel of said spherical ball when contacted by said socket member to a position wherein a portion of said ball is maintained outside of said circular rim.

5. A correction fluid dispenser as set forth in claim 3 wherein said barrel means and said socket member are manufactured of a plastic material.

6. A correction fluid dispenser as set forth in claim 1 wherein said barrel means and said socket member are manufactured of a plastic material.

7. A correction fluid dispenser as set forth in claim 1 wherein said ribs are three in number.

8. A correction fluid dispenser as set forth in claim 1 wherein each said rib end surface is directed radially inwardly to form the same angle as another rib end surface with respect to the centerline of said tubular passage.

* * * * *